US005377470A

United States Patent [19]

Hebinck

[11] Patent Number: 5,377,470

[45] Date of Patent: Jan. 3, 1995

[54] MODULAR INSULATING WALL PANEL SYSTEM

[76] Inventor: Carl Hebinck, 22646 Weeks Blvd., Land O'Lakes, Fla. 34639

[21] Appl. No.: 26,477

[22] Filed: Mar. 4, 1993

[51] Int. Cl.[6] ..... E04B 2/20

[52] U.S. Cl. ..... 52/405.1; 52/586.1; 52/309.12; 52/91.1

[58] Field of Search ..... 52/220.2, 293.3, 309.12, 52/582, 309.4, 91.1, 309.11, 238.1, 405.1, 405.2, 405.3, 405.4, 586.1, 586.2; 156/251

[56] References Cited

U.S. PATENT DOCUMENTS

| | | | |
|---|---|---|---|
| 1,998,448 | 4/1935 | Crowe | 52/220.2 |
| 2,129,441 | 9/1938 | Otto | 52/91.1 |
| 2,202,783 | 5/1940 | Morrell | 52/293.3 |
| 2,321,567 | 6/1943 | Wilson | 52/582 |
| 3,159,882 | 12/1964 | Slayter | 52/309.11 |
| 3,665,662 | 5/1972 | Timbrook et al. | 52/92 |
| 3,757,617 | 9/1973 | Fabbri | 83/1 |
| 4,147,004 | 4/1979 | Day et al. | 52/309.9 |
| 4,333,290 | 6/1982 | Koberstein | 52/376 |
| 4,435,928 | 3/1984 | Huling | 52/309.4 |
| 4,485,295 | 11/1984 | Kellermeyer | 156/251 |
| 4,578,909 | 4/1986 | Henley et al. | 52/90 |
| 4,625,476 | 12/1986 | Shimada | 52/238.1 |
| 4,674,253 | 6/1987 | Young | 52/404 |
| 4,720,948 | 1/1988 | Henley et al. | 52/90 |
| 4,852,310 | 8/1989 | Henley et al. . | |
| 4,862,660 | 9/1989 | Raymond | 52/221 |
| 5,079,885 | 1/1992 | Dettbarn | 52/282 |
| 5,172,532 | 12/1992 | Gibbar | 52/309.12 |
| 5,216,854 | 6/1993 | Emmert | 52/81.5 |

FOREIGN PATENT DOCUMENTS

| | | | |
|---|---|---|---|
| 1063816 | 12/1953 | France | 52/274 |

*Primary Examiner*—James L. Ridgill, Jr.
*Attorney, Agent, or Firm*—Pettis & McDonald

[57] ABSTRACT

A modular insulating wall panel system comprising a monolithic insulating panel incorporated within frame construction, and a method for constructing same. The frame skeleton comprises columns, studs, a sole plate and a top plate. The panel, having a plurality of edges, each with a recess therein, is inserted within the frame skeleton so that each recess receives an adjacent structural member.

16 Claims, 3 Drawing Sheets

MODULAR INSULATING WALL PANEL SYSTEM

BACKGROUND OF THE INVENTION

1. Field of the Invention

The present invention relates to a modular insulating wall panel system of the type primarily intended for use with frame construction. The wall panel system is comprised of monolithic insulating panels that are inserted within a skeleton of structural members comprising columns, studs, a sole plate and a top plate. The wall panel system is primarily intended for use as an exterior wall due to its insulating properties with regard to heat and cold; however, the wall system may be used on the interior of a structure particularly for its sound insulating properties.

2. Description of the Prior Art

Over the years, a major objective relating to improved methods for constructing buildings has been to improve the insulation R-factor of exterior walls. At the same time, cheaper constructions methods were sought, particularly through prefabrication of wall panel sections at a remote site that are then delivered to the site for erection. A number of patents have been issued for modular systems having improved insulation properties.

U.S. Pat. No. 4,147,004 issued to Day. et al., and U.S. Pat. No. 4,578,909, U.S. Pat. No. 4,720,948 and U.S. Pat. No. 4,852,310, all issued to Henley, et al., each disclose a prefabricated wall panel comprised of two sheets of a relatively thin material between which is sandwiched a layer of foam. The panels are joined together by vertical studs, or posts, to form exterior walls. The fabrication of these sandwich style panels requires that the foam material be glued or nailed between the sheet material, or mounted within a frame, to create a section of wall. The exterior siding and interior wall board is then nailed or glued to the sandwich panel. Sandwich panels of this type are normally prefabricated and brought to the construction site where they are assembled to one another. This construction technique permits little on site variation from the original construction plan. Due to this lack of flexibility, prefabricated panels are not commonly used in the construction of custom homes.

U.S. Pat. No. 4,674,253 issued to Young discloses a panel comprised of a double stud frame between which is sandwiched a foam insulating material. This system requires the construction of an interior frame and an exterior frame assembly. A second variation of the panel discloses a panel which does not have an interior frame when the panel is used adjacent a concrete slab floor, disclosing a very specific and limited use. The fabrication of these panels requires significantly increased costs over standard frame construction.

U.S. Pat. No. 5,079,885, issued to Dettbarn, discloses foam panels that are prefabricated and inserted between columns formed in the shape of I-beams. This construction technique requires the fabrication of special studs to support the preformed insulating panels and the use of splines to join the panels.

U.S. Pat. No. 4,862,660, issued to Raymond, discloses wall panels that are attached to specially prefabricated metal columns that are complex and expensive to manufacture.

It is clear then, that there remains a need for a modular insulating wall panel system that can be used in the fabrication of structures utilizing frame construction comprising vertical studs, a sole plate, top plate and corner columns. Insulating panels that can be used with current frame construction techniques provide a readily acceptable product that is easily incorporated within frame construction.

SUMMARY OF THE INVENTION

The present invention relates to a modular insulating wall panel system of the type primarily intended for use in frame construction, used in combination with a skeleton of structural members, comprising columns, studs, a sole plate and a top plate. The panel is a monolithic structure constructed of insulating material having two opposing faces and a plurality of edges. During construction, each panel is inserted so that it extends horizontally between a column and an adjacent stud or between two adjacent studs. The panel also extends vertically between the sole plate and the top plate. Each edge of the panel is formed with a recess that is sized and configured to receive at least a portion of the adjacent structural member. That is, when the panel is inserted between two studs, the recess receives generally one-half of each stud leaving the remaining half exposed and ready to be inserted in the recess of the adjacent panel. Thus, the side edges of the panels are, at the least, adjacent one another providing a smooth and generally continuous surface. The recess in the bottom of the panel receives the majority of the sole plate and the recess in the top edge receives the majority of the top plate. The sole plate is attached to a floor surface, thus, when the recess in the bottom edge of the panel receives the sole plate, the edge of the panel lies proximal to the floor surface. Also, when the recess in the top edge of the panel receives the top plate, the top edge of the panel will lie in the same plane as, or above, the finished ceiling to provide a smooth generally continuous surface from floor to ceiling.

The panels are used with normal framing materials to form a wall panel system that has a significantly increased R-factor over construction methods using roll or bat insulation materials. Various R-factors may be provided by the current system by using standard framing materials of different sizes, for example, 2×4's, 2×6's and 2×8's. As the width of the 2x material increases, the thickness of the panel must also increase providing an increased R-factor. The sole plate is installed on the flooring, which may be a slab or a wood deck, according to a predetermined plan. Construction nominally begins by installing an exterior corner column. The corner column is fabricated of 2x material including a stud at the point of attachment of each wall panel, with the width dimension of the stud being perpendicular to the length dimension of the sole plate. The recess, in the first side edge of the first panel, receives the projecting portion of the column and the recess in the bottom edge fits over the sole plate. A stud is then inserted in the recess on the second side edge of the panel with the panel's width accurately placing the studs at a preselected standard spacing, usually 24 inches. This eliminates the need to measure the location for each stud, saving installation time. The top plate is attached to the column so that the top plate is received by the recess in the top edge of the adjacent panel. The top plate is nailed to each stud as the erection of the wall panel system progresses. Erection of the insulating wall panel system continues until the exterior wall reaches the first column and closes the loop. The wall panel system, of course, may be installed on additional floors of the same structure in the same manner.

After the wall panel system has been installed, exterior finishes, such as stucco, siding, and brick may be installed using standard construction techniques. Stucco may be applied directly to the panels. Wall board is generally attached to the interior of the wall panels; however, any appropriate finish may be applied.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 2:
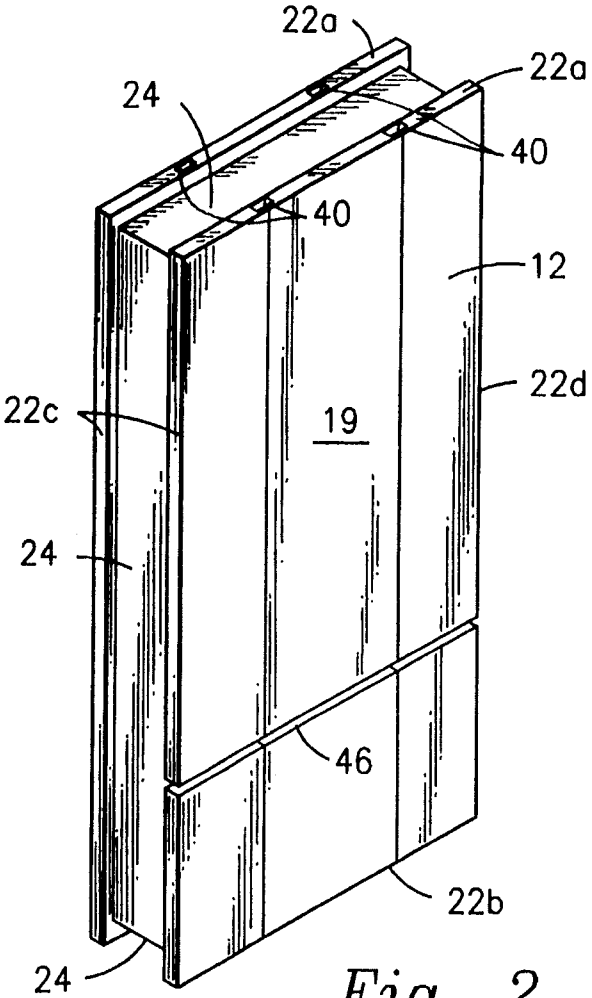
FIG. 2 is a perspective view of the complete wall panel of FIG. 1 of this invention.
Figure 3:
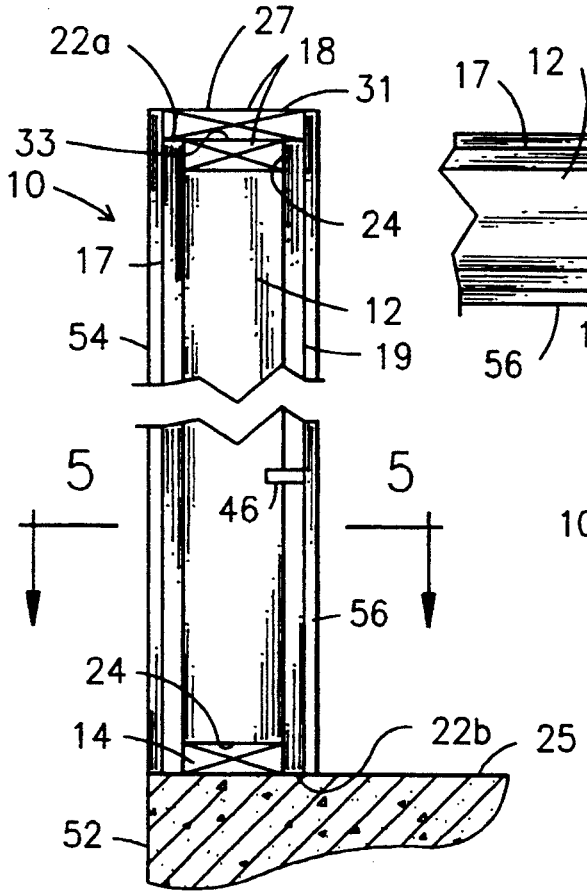
FIG. 3 is a left side sectional view of a preferred embodiment of the wall panel system, with the central portion broken out for convenience.
Figure 4:
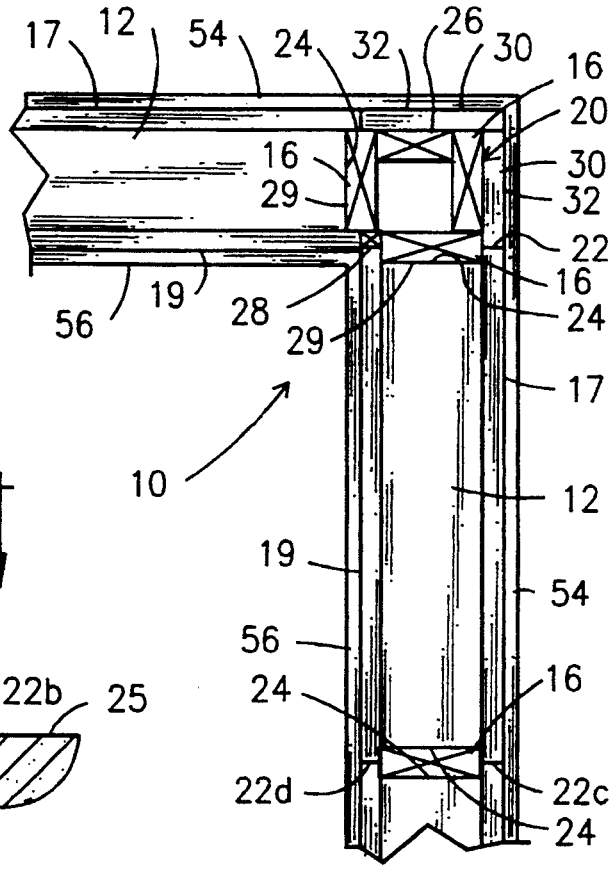
FIG. 4 is a top plan view of a preferred embodiment of the wall panel system with the top plate removed, illustrating a preferred embodiment of a corner column.

A preferred embodiment for the wall panel system of this invention is illustrated in the drawing FIGS. 1–7. The wall panel system is generally indicated as 10 in the views of FIGS. 1, 3, 4 and 5. Referring first to the view of FIG. 1, it can be seen that the wall panel system 10 comprises a plurality of wall panels 12 that are attached to a skeleton of structural members comprising a sole plate 14, a plurality of studs 16, a top plate 18, and as shown in FIG. 4, at least one column 20. As seen in FIG. 2, the wall panel 12 is monolithic in construction and is formed from an insulating material. In a preferred embodiment, the panel 12 is comprised of expanded polystyrene (EPS), which is light weight, rigid, easy to cut, and has a high insulation rating. The wall panels 12 may be formed and configured to be installed in walls comprising studs of any size, e.g. 2×4's, 2×6's, 2×8's, or any other suitably sized members. A wall panel system 10 erected utilizing framing of 2×4's requires a panel with a thickness that provides an insulation factor of approximately R-22. The increased thickness of the panel 12 when used with 2×6 structural members develops an insulation factor of approximately R-30.

Figure 1:
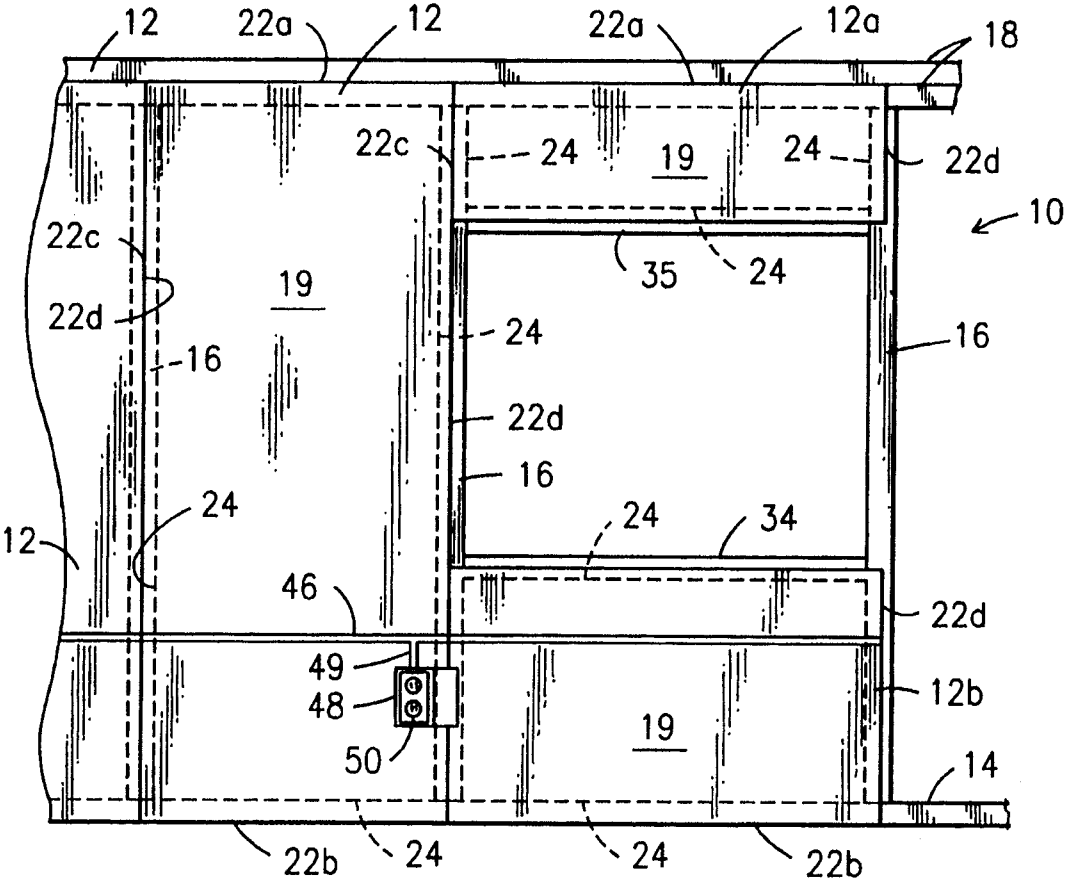
FIG. 1 is a front elevational view of a preferred embodiment of the wall panel system of this invention illustrating one complete wall panel and a wall panel configuration for a window.
Figure 5:
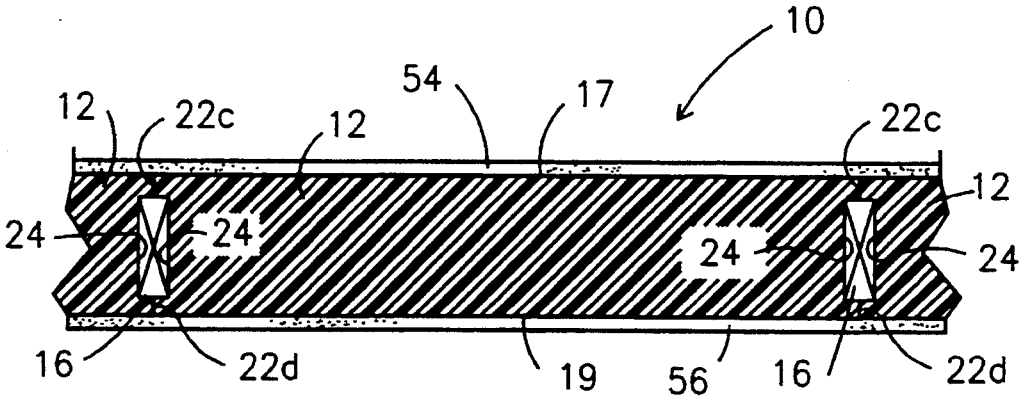
FIG. 5 is a sectional plan view of the invention taken along line 5—5 of FIG. 3.

Wall panel 12 has an exterior surface 17, an opposed interior surface 19, and a plurality of edges 22; but, when the panels are used to construct walls, the panels preferably have four edges: a top edge **22*a*, a bottom edge 22*b*, a first side edge 22*c*, and a second side edge 22*d*. Each one of the edges 22 has a recess 24 that is formed in the panel 12 extending the entire length, or height, of the panel. In FIG. 5, it can be seen that the recess 24 in first side edge 22*c*, of the fully disclosed panel, and second side edge 22*d*, of the first partial panel, are each sized and configured to receive one-half of a stud 16. Each stud 16 comprises a width, depth and length. For example, a 2×4 stud 16 is generally three and one half (3½) inches wide and one and one half (1½) inches deep. The studs 16, as shown in FIG. 4, are aligned with the depth dimension running parallel to the longitudinal direction of the wall, sole plate, etc. Therefore, one-half of the stud comprises one-half of the depth dimension as shown in FIG. 4. As shown in FIG. 1 and FIG. 3, recess 24 in the bottom edge 22*b* is sized and configured to receive the sole plate 14 therein so that the bottom edge 22*b* is adjacent the floor surface 25. As seen in FIG. 1 and FIG. 3, the recess 24 in the top edge 22*a* of the panel 12 is sized and configured to receive the top plate 18 so that the outer face 27 of the top plate 18 is generally flush with the top edge 22*a*. As shown in FIG. 1 and FIG. 4, panel 12 extends horizontally between a column 20 and the adjacent stud 16 or between two adjacent studs 16. Panel 12 also extends vertically between the sole plate 14 and the top plate 18. Panel 12 is thus framed by the studs 16, or a stud 16 and a column 20, the sole plate 14 and the top plate 18** to provide a rigid, insulated wall system.

A plurality of columns 20 are attached to the sole plate 14 so that one column 20 is installed at each point that the sole plate 14 forms a corner with itself. Each column 20 has a plurality of sides, which in a preferred embodiment, as illustrated in FIG. 4, are defined by three studs 16, a spacer 26 and a filler 28. These structural members are attached to one another by nails or other standard construction fastening techniques to form a hollow column 20. Two of the sides 29 of column 20 are sized and configured so that each of the two sides 29 are received by a respective recess 24 on an adjacent panel 12. In the preferred embodiment, as shown in FIG. 4, two of the three studs 16 of column 20 are aligned in the wall panel system 10 so that approximately half, taken longitudinally, of each stud 16 is received within a respective recess 24, which is similar to the alignment of all the other studs 16 in relation to their adjacent wall panels 12. The spacer 26 and the filler 28 provide structural strength and continuity to the column 20. The hollow column 20 is preferably filled with insulation material that in the preferred embodiment is comprised of expanded polystyrene. To provide a continuous insulated exterior surface to the structure, two insulating elements 30 are attached to the column 20 and are sized so that the exterior surface 32 of each insulating element 30 lies in the same plane as the exterior surface 17 of the adjacent wall panels 12.

In the preferred embodiment, as shown in FIGS. 1 and 3, the top plate 18 is comprised of a 2×6, that is received in the recess 24 of the top edge **22*a*, and a 2×8 member 31 that is attached to the outwardly facing surface 33, with respect to the panel 12, of the 2×6. In other embodiments, the top plate 18 may comprise a pair of 2×6's that are attached to one another and received by the recess 24 in the top edge 22*a* of the panel 12. The top plate being comprised of two structural members provides increased strength and rigidity. Clips for roof trusses (not shown) and hurricane clips (not shown) may be attached between the two structural members of the top plate 18** to increase the strength of the attachment between the roof and the walls.

FIG. 1 discloses a window opening that is framed more simply than is usually done using standard construction practices. The elimination of a header over the top of the window opening and the elimination of structural members under the sill support 34 is possible as the EPS material is rigid and capable of structural support. The window panels 12*a* and 12*b* extend between the window's structural men,hers (studs 16, header 35 and will support 34) in the same manner that panel 12 extends between the studs 12, sole plate 14 and top plate 18, with the window structural members being received by the corresponding recesses 24 in the panel edges 22.

If Upon completion of the wall panel system 10, the adjacent edges 22 of each wall panel 12 will fit smoothly and tightly together leaving little gap therebetween. Such gaps may be caulked with an appropriate caulk to provide a smooth continuous surface. In addition, the panels may be glued to the adjacent structural members with any of the well known glues that are appropriate for bonding those materials. Frequently, in standard frame construction, bracing is provided at the corners of the frame structure to prevent racking. Gluing the panels to the adjacent structural members increases the strength of the panel system 10 and eliminates the need for such bracing.

Figure 6:
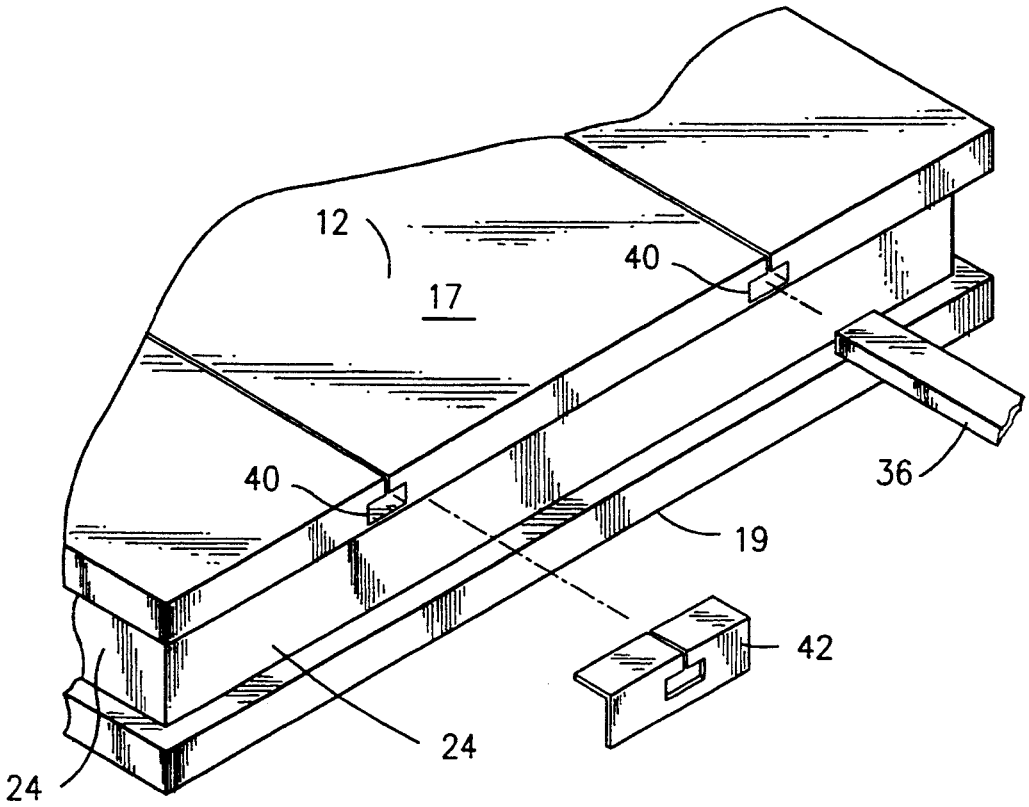
FIG. 6 is a portion of a perspective view of the invention as viewed from the bottom of the panel, illustrating the installation of furring strips.
Figure 7:
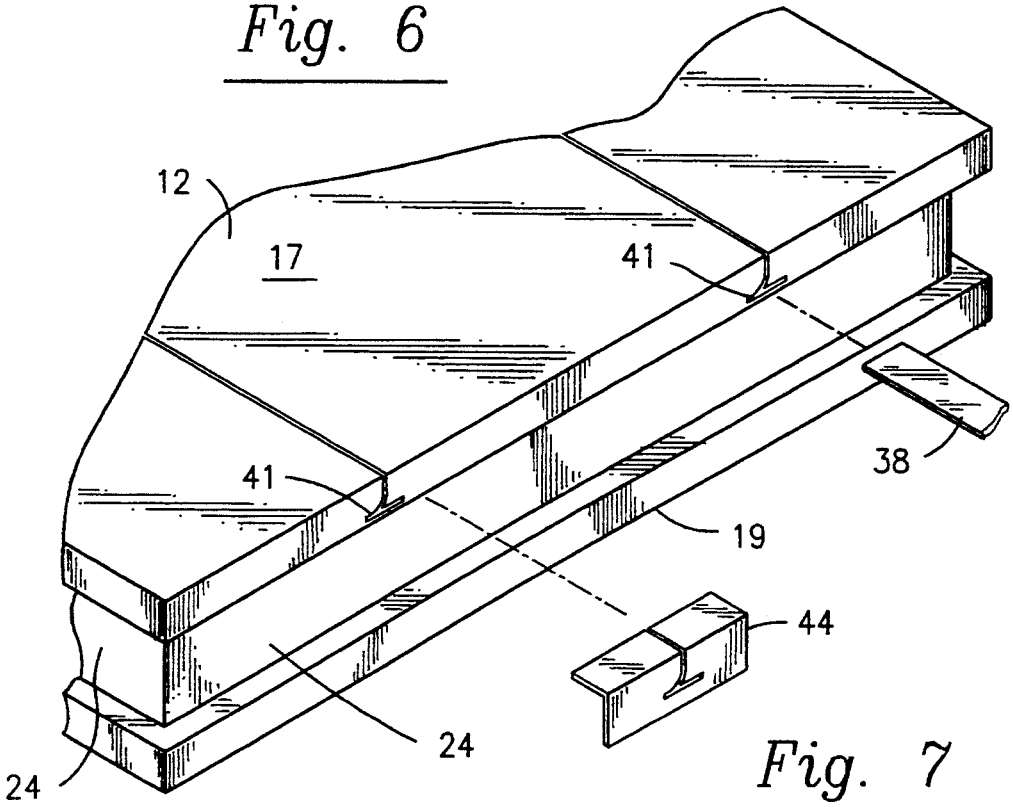
FIG. 7 is a portion of a perspective view of the invention as viewed from the bottom of the panel, illustrating the insertion of metal furring strips.

Various materials can be applied to the exterior surface 17 of the wall panels, including but not limited to siding, brick and stucco. Stucco can be applied directly to the panels 12; however, siding and brick usually require attachment to the building structure at closer intervals than 24 inches on center. Therefore, as shown in FIG. 6 and FIG. 7, wood furring strips 36 or furring strips of metal 38 may be inserted within the panel 12 prior to the panel's erection. FIG. 6 and FIG. 7 are bottom views of panel 12 that illustrate the forming of a bore 40 and a bore 41, sized and configured to receive either the wood furring strip 36 in FIG. 6 or the metal furring strip 38 as shown in FIG. 7. Cutting expanded polystyrene using the hot wire method is well known in the art. In the preferred embodiment, a bore 40 is cut into the panel 12 by placing one template 42 at the bottom of the panel and a second identical template (not shown) at the top of the panel. The hot wire is pushed into the panel 12 following the shape of the template 42 and thus cutting the bore 40. As the furring strip 36 is inserted into the bore 40, the core of the bore is pushed outwardly from the panel. The same process is used to cut a thinner bore 41 illustrated in FIG. 7 for a metal furring strip.

A channel 46 having sufficient width to receive electrical wiring (not shown) may be precut into the panel 12 at an appropriate distance from the bottom edge 22*b* of panel 16. In the preferred embodiment, a channel depth of two inches is used to conceal and protect the wiring in the panel 12. This depth of channel 46 requires that after the installation of the panels 12, the studs 16 must be cut utilizing standard construction methods so that the channel 46 is continuous in depth around the wall panel system 10. Holes 48 may be easily cut into the polystyrene and are sized and configured to receive standard electrical boxes 50. Appropriate wiring channels 49 are cut to join channel 46 with the outlet boxes 50.

Having thus set forth a preferred construction for the insulating wall panel 12 and for the insulating wall panel system 10 of this invention, it is to be remembered that this is but a preferred embodiment. Attention is now invited to a description of the method of erecting such a wall panel system 10.

A site must be prepared by standard construction practices and a foundation constructed to support flooring 25 and the wall panel system 10. Usually a wood deck set upon concrete footers or a concrete slab 52 supported by concrete footers (not shown) comprises the floor 25 of the structure. A sole plate 14 is attached around the perimeter of the concrete slab 52 as shown in FIG. 3. Construction of the wall panel system 10 will normally begin at a corner of the structure where the sole plate 14 forms a 90° angle with itself. A column 20 is attached to the sole plate by toenailing or other appropriate well known construction means. The column 20 in FIG. 4 has been constructed for a 90° angle; columns having different corner angles may be constructed as necessary. Panel 12 is then mounted upon the sole plate 14 so that the recess 24 of the bottom edge 22*b* receives the sole plate 14. The panel 12 is then slid toward the column 20 until the recess 24 of the first side edge 22*c* receives the side 29 of the column 20 that comprises a portion of stud 16. The next step requires the placement of a stud into the recess 24 of the second edge 22*d* of the panel 12. The panel being 24 inches in width from edge 22*c* to edge 22*d* dictates that the studs will be on 24 inch centers. Since panels of any width may be used, in other embodiments, the studs 16 may be spaced apart at any predetermined dimension. As mentioned previously, the panel 12 may be glued to the adjacent structural members during the erection process. After the stud 16 has been inserted in the recess 24 of the second side edge 22*d*, it is nailed in to the sole plate 14 by toenailing. One of the members of the top plate 18 is placed into the recess 24 in the top edge 22*a*. The top plate 18 is nailed to the column 20 and placed in the recess 24 in the top edge 22*a*. The next panel is then mounted to the sole plate and to the stud 16 so that each structural member adjacent to the panel 12 rests in an adjacent recess 24. The next stud 16 is inserted in the second side edge 22*d* of the next panel 12 and the stud is nailed to the sole plate 14 and the top plate 18 is nailed to the stud 16. These steps are repeated as often as necessary to complete the wall panel system 10 to the next corner. At the next column 20, the panel 16 is received by the side 29 of the column 20 that comprises a portion of stud 16. The construction of the wall system 10 continues on the other side of the column 20, repeating the above steps.

When a window installation is required as shown in FIG. 1, panels will have to be cut to fit between the window structural members such as the sill support 34 and the 2×6 header 35. Windows are inserted in the frame using standard construction practices. The spacing between the columns 20 and the adjacent stud 16 or between studs 16 frequently may differ from the predetermined panel 12 width, usually 24 inches on center. The width of the panels 12 may be changed by simply sawing the panels 12 with standard construction tools to remove a central portion thereby reducing the panel's width. The two remaining parts are then glued together to form the new panel that is sized to the desired width. Panels 12 may be cut to fit as often as needed without any reduction in the strength of the structure.

The erection steps are repeated as often as necessary until the entire wall panel system 10 has been installed. The studs 16 that cross the channel 46 where wiring is to be placed are now cut and the wiring inserted in accordance with standard practices. The wall panel system 10 is now ready for the finish material both on the inside panel surface 19 and on the exterior panel surface 17. The exterior materials 54 are nailed to the studs 16, to the columns 20, and to the furring strips 36. Wallboard 56 or other well known materials may be applied to the interior surface 19 of the wall panel system 10 by gluing directly to the panel 12, or by fastening with nails or screws to the studs 16.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A modular insulating wall panel for use with walls constructed of a skeleton of structural members comprising studs, said wall panel comprising:

a monolithic structure having two opposing generally parallel surfaces and a plurality of edges, including a bottom edge, a first side edge and a second side edges, each of said side edges having a recess formed therein, a plurality of studs, having a predetermined width and a predetermined depth, said recess in each said side edge receiving one half of said depth of one of said studs when said wall panel is mounted to the structural members, said wall panel further comprising at least one furring strip inserted intermediate said opposing surfaces of said panel and said strip being substantially encased within said panel.

2. A wall panel as in claim 1 wherein said furring strip is inserted at a predetermined spacing from said first side edge of said panel, said strip being generally perpendicular to said bottom edge of said panel and generally parallel and proximal to one of said opposing faces.

3. A modular insulating wall panel system of the type primarily intended for use as a portion of the walls of frame structures, the structures having a floor upon which the walls are raised, said wall panel system comprising:

a sole plate attached to a floor of a structure in accordance with a predetermined plan;

a plurality of studs, each of said studs having a predetermined width and a predetermined depth and a first and a second end, said first end of each said stud being attached to said sole plate and extending generally normal therefrom, said adjacent studs being spaced apart from one another by a predetermined distance;

a top plate attached to said second ends of said studs; and a plurality of monolithic panels each having two opposing generally parallel surfaces and a plurality of edges including a first side edge, a second side edge, a bottom edge and a top edge, each of said edges having a recess formed therein, one of said panels extending between each pair of adjacent ones of said studs and extending between said sole plate and said top plate, said recess in each said side edge of said panel receiving one half of said depth of said adjacent stud, said recesses in said bottom edge and said top edge being sized and configured such that at least a portion of said sole plate and at least a portion of said top plate is received by an adjacent one of said recesses, at least one of said plurality of panels further comprising at least one furring strip inserted intermediate said opposing surfaces of said panel and said strip being substantially encased within said panel.

4. A wall panel system as in claim 3 wherein said panels extending between adjacent ones of said studs are bonded to said adjacent studs, said sole plate, and said top plate, and wherein said panels extending between said columns and said adjacent studs are bonded to said adjacent studs, said adjacent columns, said sole plate, and said top plate.

5. A wall panel system as in claim 3 further comprising a channel in said panels, said channel being proximal said sole plate and extending continuously and generally parallel to said sole plate, whereby wiring may be inserted in said wall panel system.

6. A wall panel system as in claim 3 wherein said panels further comprise a bottom edge, a first side edge and a second side edge, and wherein said panel further comprises at least one furring strip inserted intermediate said opposing faces of said panel at a predetermined spacing from said first side edge of said panel, said strip being generally perpendicular to said bottom edge of said panel and generally parallel to and proximal to one of said opposing faces.

7. A wall panel system as in claim 3 wherein each said recess extends inwardly from said adjacent edge of said monolithic panel intermediate said surfaces of said panel.

8. A wall panel system as in claim 3 wherein said sole plate further comprises a plurality of corners formed therein and said panel system further comprises a plurality of corner columns, each of said columns having a first end and a second end, said first end of one of said plurality of columns being attached to each one of said corners of said sole plate extending generally vertically therefrom, one of said plurality of panels extending between each one of said columns and an adjacent one of said studs and extending between said sole plate and said top plate, said recess in one of said sides being sized and configured to receive at least a portion of said column, said recess in said bottom edge being sized and configured to receive at least a portion of said sole plate, and said recess in said top edge being sized and configured to receive at least a portion of said top plate.

9. A wall panel system as in claim 8 wherein said column comprises:

a plurality of sides, two of said plurality of sides being sized and configured to be received by said recess in said side edge of a respective adjacent said panels, such that said remaining sides of said plurality of sides remain exposed.

10. A wall panel system as in claim 9 wherein said column further comprises three studs and a spacer, said studs and spacer being attached to one another forming a column having a hollow portion, an insulating material disposed in said hollow portion, and an insulating element attached to each of said exposed sides of said column, said elements having an exterior surface and said elements sized and configured so that said exterior surface of said element lies in the same plane as the adjacent surface of said panel.

11. A method of erecting an insulating wall panel system during the construction of a structure, comprising the steps of:

a. attaching a sole plate to a floor of the structure;

b. providing a plurality of corner posts;

c. attaching a corner post to said sole plate so that it extends generally vertically upwardly to define a first corner;

d. providing a plurality of modular insulating wall panels, each of said wall panels being a monolithic construction having two opposing surfaces and at least four edges comprising a bottom edge, a top edge, a first side edge and a second side edge, each of said four edges having a recess therein, at least one of said plurality of wall panels further comprising at least one furring strip inserted intermediate said opposing surfaces of said panel and said furring strip being substantially encased within said panel;

e. mounting a first modular insulating wall panel to said sole plate and to said corner post, said recess in said bottom edge of said wall panel being sized and configured to receive said sole plate, said recess in said first edge being sized and configured to receive a portion of said corner post;

f. providing a plurality of studs;

g. attaching one said stud to said sole plate such that said stud extends generally vertically upwardly from said sole plate and a portion of said stud is received by said recess in said second side edge of said wall panel;

h. attaching a top plate to said corner post such that at least a portion of said top plate is received by said recess in said top edge of said first wall panel;

i. mounting a next wall panel to said sole plate such that said sole plate is received by said recess in said bottom edge of said next wall panel, and said recess in said first side edge of said next wall panel receives a portion of said vertical stud received by said recess in said second side edge of said first wall panel, generally abutting said second side edge of said first wall panel against said first side edge of said next wall panel;

j. attaching a next said stud to said sole plate such that a portion of said next stud is received by said recess in said second side edge of said first wall panel;

k. repeating steps i. and j. until a next corner is reached, continuing to attach said top plate to said studs, and then installing a next corner post to said next corner such that said recess in said second edge of the previous one of said wall panels receives a portion of said corner post and said top plate is received by said recess in said top edge; and l. repeating steps e. and g. through j. until said wall system is closed in accordance with a predetermined plan.

12. A method of erecting a wall panel system as in claim 11, further comprising, after step d., the additional step of:

cutting a channel in at least one of said faces of said panels, said channel being proximal to said sole plate extending continuously and generally parallel to said sole plate;

and further comprising, after step l. the additional step of:

cutting a channel in said studs and in said columns to continue said channel in said panels, whereby wiring may be inserted in said wall system.

13. A method of erecting a wall panel system as in claim 11 further comprising, as an additional step in step e., the step of:

bonding said panel to said sole plate and to said corner post.

14. A method of erecting a wall panel system as in claim 11 further comprising, as an additional step in step g., the step of:

bonding said panel to said stud.

15. A method of erecting a wall panel system as in claim 11 further comprising, as an additional step in step h., the step of:

bonding said panel to said top plate.

16. A method of erecting a wall panel system as in claim 11 further comprising, as an additional step in step i., the step of:

bonding said panel to said sole plate, said stud and said top plate.

* * * * *

UNITED STATES PATENT AND TRADEMARK OFFICE

CERTIFICATE OF CORRECTION

PATENT NO. : 5,377,470

DATED : January 3, 1995

INVENTOR(S) : Carl Hebinck

It is certified that error appears in the above-identified patent and that said Letters Patent is hereby corrected as shown below:

Column 8, line 60 and 61, delete "panels" and insert therefor --panel--.

Signed and Sealed this

Seventh Day of March, 1995

*Attest:*

*Attesting Officer*

BRUCE LEHMAN

*Commissioner of Patents and Trademarks*